US006659453B2

(12) United States Patent
Kelm et al.

(10) Patent No.: US 6,659,453 B2
(45) Date of Patent: Dec. 9, 2003

(54) DELIVERY FOR A MACHINE PROCESSING FLAT PRINTING MATERIALS

(75) Inventors: Carsten Kelm, Ketsch (DE); Udo Lautenklos, Wald-Michelbach (DE); Roland Angert, Pfungstadt (DE); Peter Wilhelm Gögele, Wiesloch (DE); Norbert Thünker, Hirschberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/112,533

(22) Filed: Mar. 28, 2002

(65) Prior Publication Data

US 2002/0140166 A1 Oct. 3, 2002

(30) Foreign Application Priority Data

Mar. 28, 2001 (DE) ..... 101 15 319

(51) Int. Cl.[7] ..... B65H 29/68

(52) U.S. Cl. ..... 271/183; 271/204; 271/280; 271/300

(58) Field of Search ..... 271/204, 280, 271/300, 298, 183

(56) References Cited

U.S. PATENT DOCUMENTS 4,830,355 A 5/1989 Jeschke
5,568,919 A * 10/1996 Detmers et al. ..... 271/183
5,649,483 A 7/1997 Mack et al.
2001/0026042 A1 * 10/2001 Kerpe et al. ..... 271/183

FOREIGN PATENT DOCUMENTS

DE 36 34 400 A1 4/1988
DE 288 581 B5 4/1991
DE 195 19 374 C2 11/1996

* cited by examiner

*Primary Examiner*—Donald P. Walsh
*Assistant Examiner*—Kaitlin Joerger
(74) *Attorney, Agent, or Firm*—Laurence A. Greenberg; Werner H. Stemer; Ralph E. Locher

(57) ABSTRACT

A delivery for a machine processing flat printing materials includes a suction belt conveyer having conveying runs forming a support surface. To remove rejects or proof sheets as required, the delivery transports the materials along a transport path over a stack that is otherwise built up and transfers the sheets to the support surface. The physical position of the support surface can be varied while maintaining its generatrix. Therefore, the support surface can be adjusted in each print job to a working position in which secured transfer of removed printing materials to the suction belt conveyer is ensured. In a particular configuration, a latching device is provided that permits the conveying runs to escape from their working position in the event of a jam. Preferably, the latching device has a latching pin and a latching recess.

14 Claims, 5 Drawing Sheets

DELIVERY FOR A MACHINE PROCESSING FLAT PRINTING MATERIALS

BACKGROUND OF THE INVENTION

Field of the Invention

The invention relates to a delivery for a machine processing flat printing materials, in particular, a sheet-processing rotary printing machine. The printing machine has gripper systems that circulate during operation, drag a respective one of the processed sheets in a transport direction along a transport path, and optionally release it at a first location on the transport path to form a stack or a second location on the transport path, placed downstream of the first location with respect to the transport direction. The machine also has a suction belt conveyor with suction belt modules that include conveyor runs that, during operation, run off a respective first roller and run onto a respective second roller, disposed downstream of the first roller with respect to the transport direction, a support surface formed by the conveyor runs for one of the sheets released at the second location, and mutually parallel generatrices of the transport path and of the support surface.

Such a delivery suitable for removing rejects and proof sheets is disclosed by German Patent DE 195 19 374 C2, corresponding to U.S. Pat. No. 5,649,483 to Mack et al. As a result of the attempt to keep the extent of the delivery in the transport direction as small as possible beyond the stack, the gripper systems that normally run horizontally above the stack change over into a deflection area, in which they are removed from the suction belt conveyor, possibly already before, but at least immediately after the sheets have been released at the aforementioned second location on the transport path. However, secure picking up of the sheets by the suction belt conveyor requires a leading end of the respective sheet released at the second location already to be gripped by the suction belt conveyor under the suction action of the latter. To ensure security of the process, that is to say, the secure picking up of the processed printing materials, strict compliance with a specific mutual association between the transport path and the support surface is necessary. An erroneous mutual association, forming too large a gap between the sheets released at the second location and the support surface formed by the conveyor runs of the suction belt conveyor, results in the sheets not being able to be picked up by the conveyor runs because an adequate suction action effective on a respective sheet is built up by the suction belt conveyor only in the immediate vicinity of the support surface and also only when the respective sheet is located in the immediate vicinity of the support surface.

The process of transferring the leading ends of the sheets from a gripper system to the suction belt conveyor is extremely sensitive to deviations from a specific mutual association between suction belt conveyors and gripper systems, so that even an unfavorable coincidence of production tolerances can lead to disruptions of the process.

SUMMARY OF THE INVENTION

It is accordingly an object of the invention to provide a delivery for a machine processing flat printing materials that overcomes the hereinafore-mentioned disadvantages of the heretofore-known devices of this general type and that configures the delivery to ensure security of the aforementioned process.

With the foregoing and other objects in view, there is provided, in accordance with the invention, a delivery for a machine processing flat printing materials in a transport direction along a transport path, the transport path defining a transport generatrix, the delivery including circulating gripper systems each dragging a printing material in the transport direction along the transport path during operation of the machine and selectively releasing the printing material at one of a first location on the transport path to form a material stack or a second location on the transport path downstream of the first location with respect to the transport direction, a suction belt conveyer with suction belt modules each having a first roller, a second roller disposed downstream of the first roller with respect to the transport direction, and a conveying run connected to the first roller and to the second rollers and running from the first roller to the second roller during operation of the machine, the conveying run of each of the suction belt modules forming a variable support surface for a printing material released at the second location, the variable support surface defining a support generatrix oriented parallel to the transport generatrix of the transport path, and a physical position of the support surface being variable while maintaining an orientation of the support generatrix. Preferably, the delivery is for a sheet-processing rotary printing machine and the printing material is a sheet.

In order to achieve this object, provision is made for the physical position of the support surface to be variable while maintaining the orientation of its generatrix.

As a result of this measure, that is to say, in particular, as a result of appropriate adjustment of the support surface, a secure process association between the support surface and the transport path and, therefore, a secure transfer can be brought about, without increased requirements on minimization of production tolerances having to be met. Moreover, the configuration according to the invention also permits the physical position of the support surface to be matched to printing materials having different thicknesses.

In accordance with another feature of the invention, the suction belt conveyer has a geometric axis parallel to the transport generatrix of the transport path and the suction belt conveyer is selectively adjustable to different working positions by pivoting about the geometric axis.

In accordance with a further feature of the invention, the machine has a frame, and the delivery includes a crossmember defining the geometric axis, pivotably mounted in the frame about the geometric axis, selectively adjustable to different pivoting positions, and carrying the suction belt conveyer. in accordance with an added feature of the invention, there is provided an actuating drive connected to the crossmember and pivoting the crossmember about the geometric axis.

In accordance with an additional feature of the invention, there is provided a swinging arm connected to the crossmember and a mechanism having two sides, a first of the sides connected to the frame and a second of the sides connected to the swinging arm, the connection of the swinging arm to the second side forming a pivot mechanism for the crossmember about the geometric axis.

In accordance with yet another feature of the invention, there is provided a pivot mechanism having two sides, a first of the sides connected to the frame and a second of the sides connected to the swinging arm for pivoting the crossmember about the geometric axis.

In accordance with yet a further feature of the invention, the mechanism is a screw device and includes a threaded spindle and a spindle nut configuration moveably connected to the threaded spindle. Preferably, the spindle nut configuration is rotatably connected to the threaded spindle without play.

In accordance with yet an added feature of the invention, the mechanism has a spindle housing connected to the frame, the spindle housing accommodates the threaded spindle to axially fix the threaded spindle and permit rotation of the threaded spindle, and the spindle nut configuration is connected articulatedly to the swinging arm.

In accordance with yet an additional feature of the invention, the mechanism is adjustable between a plurality of latching positions.

In accordance with again another feature of the invention, the suction belt modules are adjustable between a working position and a position located away from the working position, a locking device releasably fixes each of the suction belt modules in the working position, and the locking device releases a respective one of the suction belt modules from the working position through a transverse force loading the conveying run of the one suction belt module.

In accordance with again a concomitant feature of the invention, each of the suction belt modules has a carrying frame and a bearing block connected to the carrying frame to permit pivoting of the carrying frame with respect to an axis of rotation of the second roller, and the locking device has a pre-stressed latching pin connected between the carrying frame and the bearing block.

Other features that are considered as characteristic for the invention are set forth in the appended claims.

Although the invention is illustrated and described herein as embodied in a delivery for a machine processing flat printing materials, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

With a delivery of the type mentioned in the introduction, in particular, a sheet-processing printing machine can be operated in a first operating state in which the processed sheets—i.e., printed sheets—are stacked before further processing and—as a rule briefly—in a second operating state in which—for example, for documentation or other purposes—sheets are removed over a corresponding stacking station.

Figure 1:
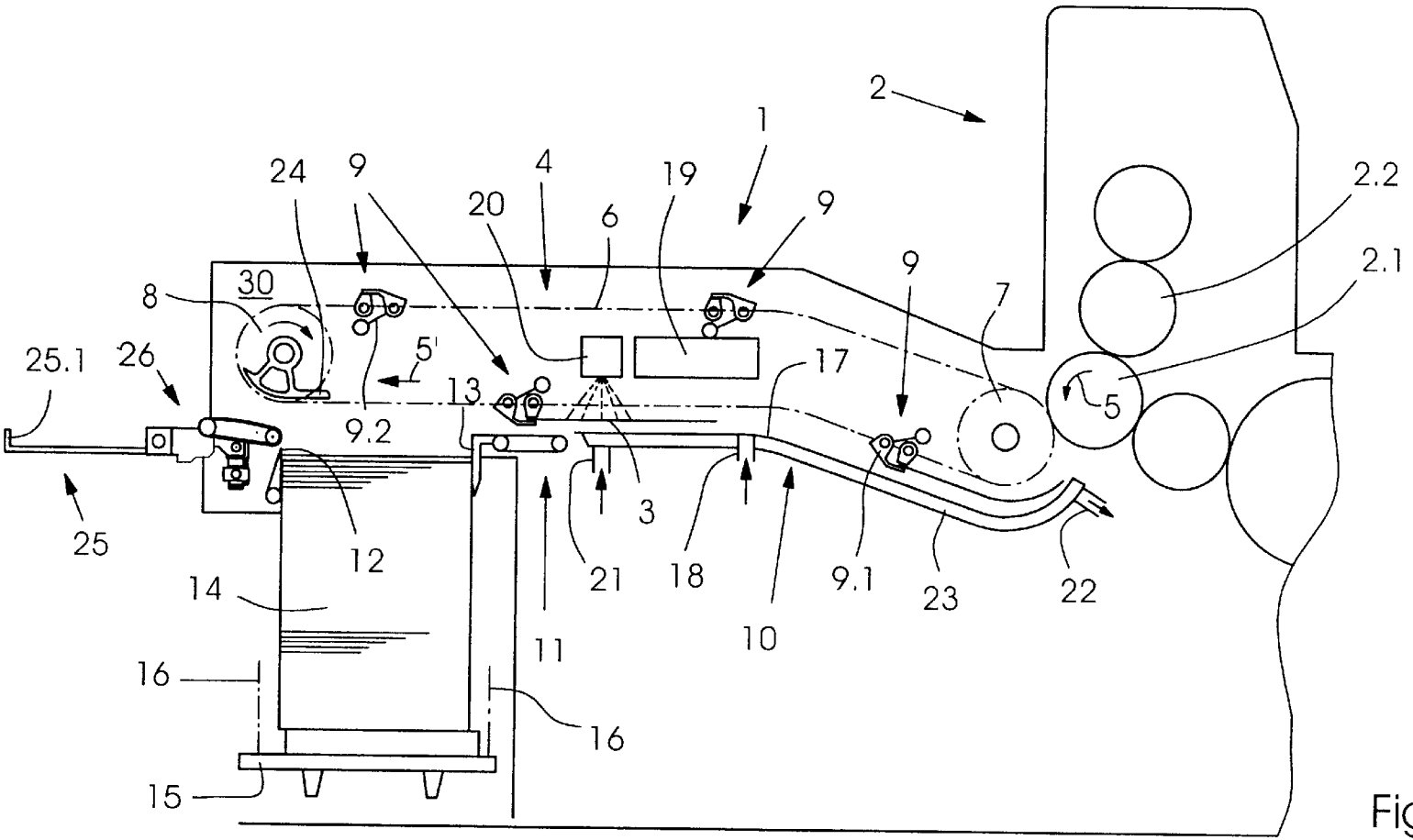
FIG. 1 is a fragmentary, diagrammatic, cross-sectional view of a sheet-processing rotary printing machine having a delivery according to the invention.

Referring now to the figures of the drawings in detail and first, particularly to FIG. 1 thereof, there is shown a delivery 1 that follows a last processing station of the printing machine. Such a processing station can be a printing unit or a post-treatment unit, such as a varnishing unit. In the present example, the last processing station is a printing unit 2 operating on the offset process and having an impression cylinder 2.1. The impression cylinder 2.1 carries a respective sheet 3 in a processing direction indicated by the direction-of-rotation arrow 5 through a press nip between the impression cylinder 2.1 and a blanket cylinder 2.2 cooperating therewith and then transfers the sheet 3 to a chain conveyor 4 while opening grippers disposed on the impression cylinder 2.1 and provided to grip the sheet 3 at a gripper edge at the leading end of the sheet. The chain conveyor 4 includes two conveyor chains 6 of which a respective one, in operation, circulates along an inner side of a non-illustrated side wall of the delivery 1 respectively associated with a frame 30 of the delivery 1. See FIG. 3. A respective conveying chain 6 wraps around each of two synchronously driven drive sprockets 7, whose axes of rotation are aligned with each other, and is guided over a deflection respective sprocket 8 located downstream of the drive sprockets 7 with respect to the processing direction. Between the two conveyor chains 6 there extend gripper systems 9, borne by the chains 6, with automatically closing grippers 9.1 that, in operation, pass through a closed gripper path and gaps between the grippers disposed on the impression cylinder 2.1 and, in the process, accept a respective sheet 3, by gripping the aforementioned gripper edge at the leading end of the sheet 3, directly before the grippers disposed on the impression cylinder 2.1 open, drag it along a transport path in a transport direction 5' over a sheet guide device 10 to a sheet brake 11, and open there in a switching position of a switching element 24, explained in due course, to transfer the sheet 3 to the sheet brake 11. The sheet brake 11 imparts to the sheet 3 a deposit speed that is reduced with respect to the processing speed and, after reaching the deposit speed, in turn, releases it so that a respective, now decelerated sheet 3 finally strikes leading-edge stops 12. The sheet 3 is aligned on the leading-edge stops 12 and on trailing-edge stops 13 located opposite thereto. Together with preceding and/or following sheets 3, the deposited sheet 3 forms a stack 14 that can be lowered by a lifting mechanism to the extent to which the stack 14 grows. Of the lifting mechanism, FIG. 1 reproduces only a platform 15 that carries the stack 14 and lifting chains 16 that carry the platform 15 and are indicated with dash-dotted lines.

Along their paths between the drive sprockets 7, on one hand, and the deflection sprockets 8, on the other hand, the conveyor chains 6 are guided by non-illustrated chain guide rails that, thus, determine the chain paths of the chain runs and also the course of the gripper path. In the present example, the sheets 3 are transported by the lower chain run in FIG. 1. The section of the chain path through which the chain run passes is followed by a sheet guide surface 17 that faces the section and is formed on the sheet guide device 10. In operation, a carrying-air cushion is preferably formed between the sheet guide surface 17 and the sheet 3 respectively guided thereover. For such a purpose, the sheet guide device 10 is equipped with blown-air nozzles that open into the sheet guide surface 17 and of which, in FIG. 1, only one is reproduced as representative of all of them, and in symbolic representation in the form of the nozzle 18.

To prevent mutual sticking of the printed sheets 3 in the stack 14, a dryer 19 and a powdering device 20 are provided on the path of the sheets 3 from the drive sprockets 7 to the sheet brake 11.

To avoid excessive heating of the sheet guide surface 17 by the dryer 19, a coolant circuit is integrated into the sheet guide device 10, and is indicated symbolically in FIG. 1 by an inlet nozzle 21 and an outlet nozzle 22 on a coolant trough 23 associated with the sheet guide surface 17.

In operation, the grippers 9.1 of a respective gripper system 9 pass through a gripper path determined by the chain paths of the chain runs and, under the action of a non-illustrated spring configuration, are pre-stressed into a closed position of the grippers 9.1. To open the grippers 9.1, a respective gripper system 9 is equipped with a roller lever configuration 9.2 that can be actuated by the switching element 24 such that it temporarily opens the normally closed grippers 9.1 when it comes into contact with the switching element 24. In an exemplary configuration, the switching element 24 can be adjusted, as disclosed in German Published, Non-Prosecuted Patent Application DE 100 37 257, between a basic position that is, in particular, adjustable, and an extreme position. In a respectively adjustable basic position of the switching element 24, the grippers 9.1 open at a first location, determined by the basic position, on the gripper path and, therefore, on the transport path 28 and release a respective one of the sheets 3 to form the stack 14; while in the aforementioned extreme position, the sheets 3 are released at a second location, placed downstream of the first location with respect to the transport direction, on the gripper path and, therefore, on the transport path 28 so that the released sheets 3 no longer strike the leading-edge stops 12 but move beyond these and ultimately pass to a suitable collecting device 25 that is used to hold proof sheets or rejects.

German Patent DE 195 19 374 C2, corresponding to U.S. Pat. No. 5,649,483 to Mack et al., discloses an advantageous configuration of such a collecting device, and is hereby incorporated herein by reference.

Before the sheets released at the second location on the transport path 28 ultimately pass into the collecting device 25, they are transferred by the respective grippers 9.1 to a suction belt conveyor 26. The suction belt conveyor 26 is reproduced in a side view in FIG. 2 and, partly sectioned, in a plan view in FIG. 3 and includes a plurality of conveying modules 26.1 that each enclose a suction belt module 27 that respectively has a conveying run 27.1 that runs off a first roller 27.2 and runs onto a second roller 27.3 disposed downstream of the first roller 27.2 with respect to the transport direction 5'. The conveying runs 27.1 form a support surface 27.4 that is provided to pick up the sheets 3 released at the aforementioned.second location. The support surface 27.4 and the transport path 28 have mutually parallel generatrices.

The grippers 9.1 of a respective gripper system 9 in each case form a gripper finger 9.1' and a gripper pad 9.1". The respective gripper finger 9.1' is pre-stressed in a direction of the gripper pad 9.1". A sheet 3 transported by the grippers 9.1 is clamped in between the gripper fingers 9.1', on one hand, and clamping surfaces facing these on the gripper pads 9.1", on the other hand. To this extent, an area through which the aforementioned clamping surfaces of the gripper pads 9.1" passes while the gripper systems 9 are dragging a sheet 3 can be viewed as the aforementioned transport path 28. The generatrix of such an area, that is to say, of the transport path 28, is oriented horizontally in the case of the delivery explained, and the generatrix of the aforementioned support surface 27.4 is parallel to that of the transport path 28.

Figure 2:
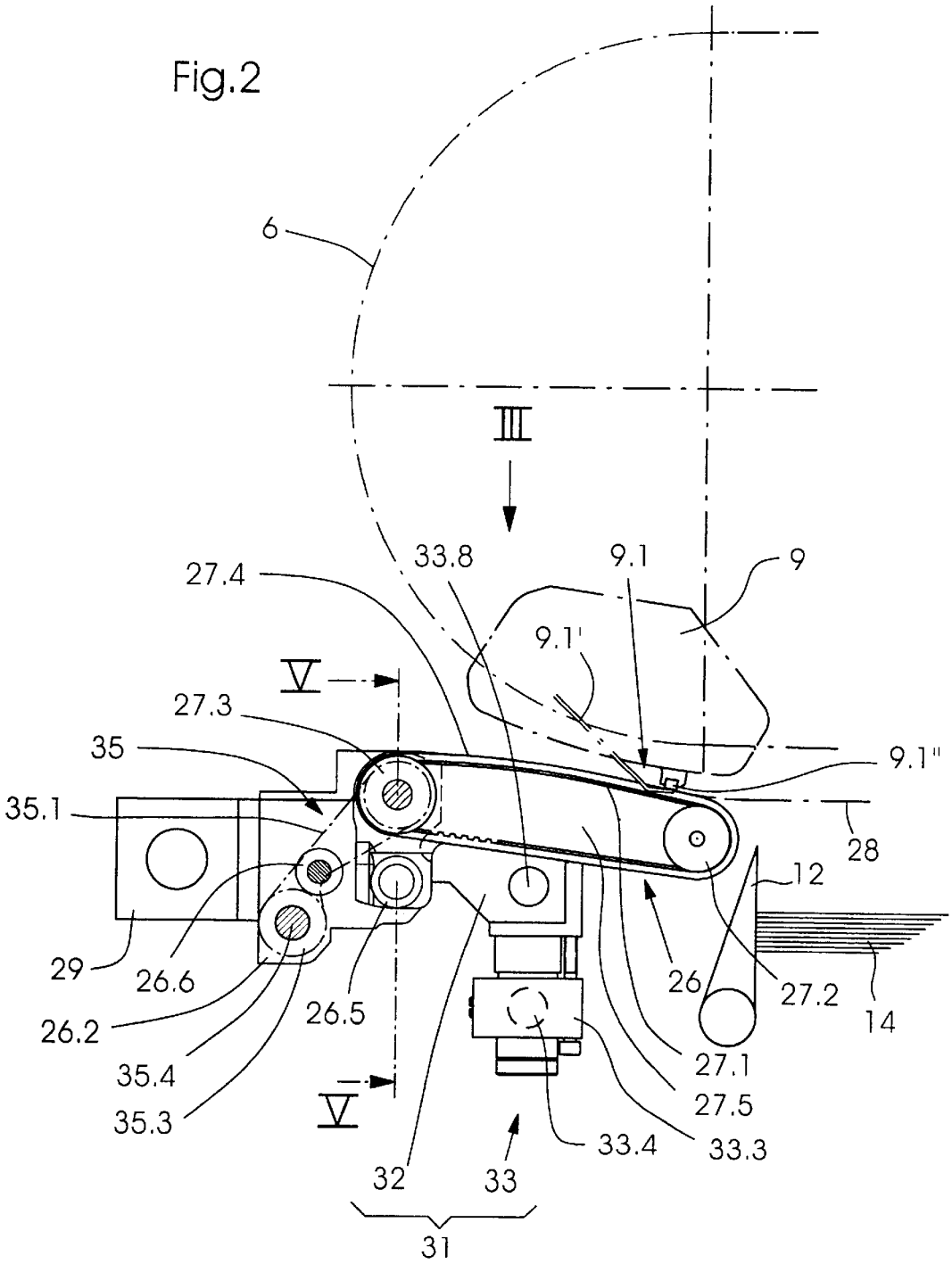
FIG. 2 is a diagrammatic, enlarged, cross-sectional view of an end section of the delivery of FIG. 1 disposed downstream with respect to the transport direction.
Figure 3:
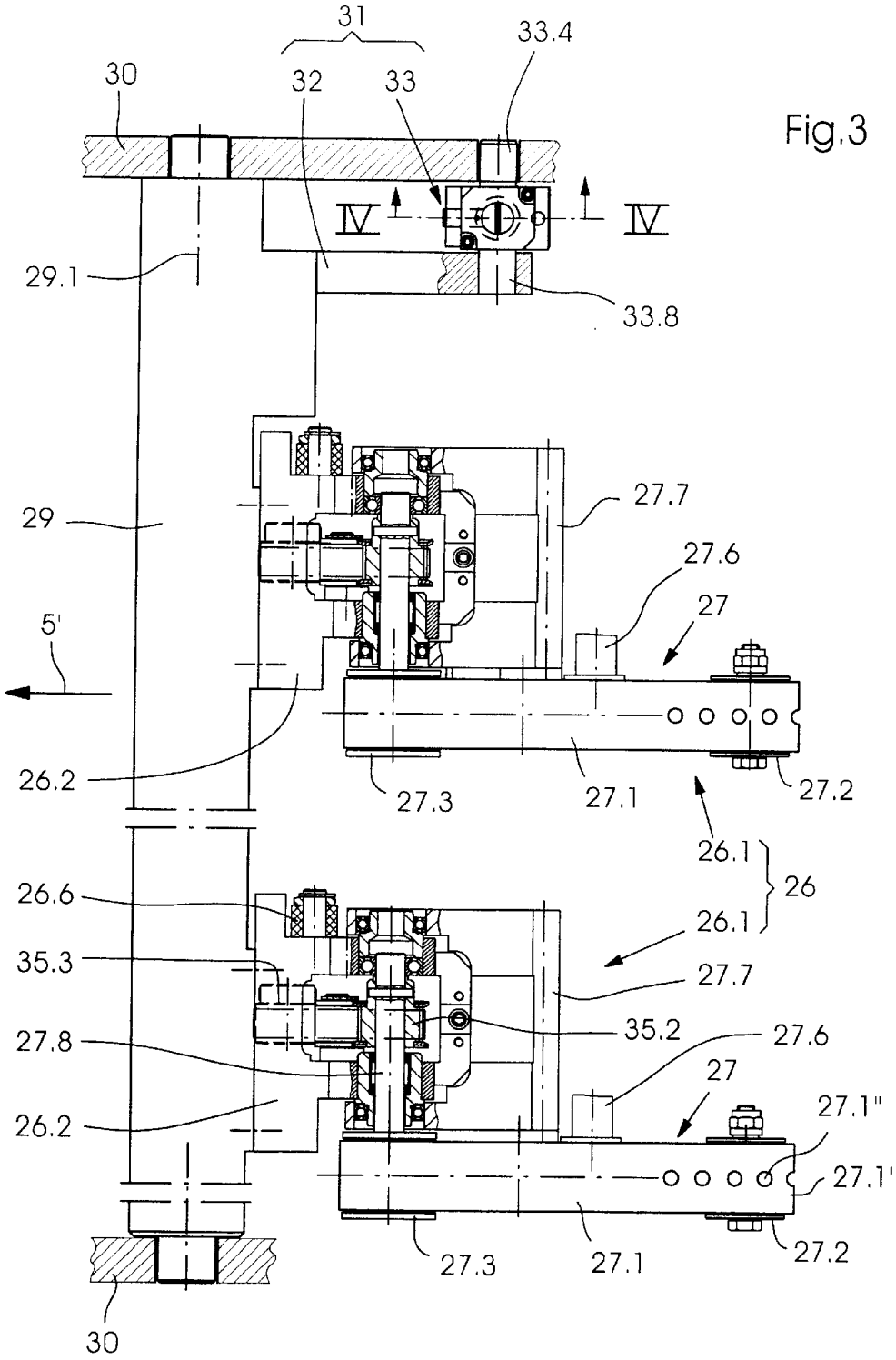
FIG. 3 is a fragmentary, enlarged, cross-sectional view of the delivery of FIG. 2 in a direction of arrow III.

A respective conveying run 27.1 of an endless suction belt 27.1' provided with suction openings 27.1" and wrapping around the first and second roller 27.2 and 27.3 sweeps over a suction box 27.5 that is indicated in FIG. 2 and has the non-illustrated suction opening facing the conveying run 27.1 and—as can be seen in FIG. 3—a suction nozzle 27.6 that can be connected to a non-illustrated vacuum generator. The suction box 27.5 is fixed to a carrying frame 27.7. The carrying frame 27.7 has a bearing block 26.2 that accommodates the block 26.2 such that it can be pivoted with respect to the axis of rotation of the second roller 27.3 and with respect to which the carrying frame 27.7 and, therefore, the suction belt module 27 can be locked, in a manner explained later, in a working position of the suction belt module 27. The bearing block 26.2 is carried by a crossmember 29 that extends parallel to the generatrices of the transport path 28 and the support surface 27.4 and, at its respective ends, is accommodated in the non-illustrated side walls belonging to the frame 30 of the delivery 1 such as it can be pivoted about a geometric axis 29.1 formed by the crossmember 29 and parallel to the generatrices of the transport path 28 and of the support surface 27.4.

The suction belt module 27 locks—as mentioned—on the bearing block 26.2, in turn carried by the crossmember 29, can be adjusted on pivoting bearings, which are adjustable as explained below.

Operatively connected to the crossmember 29 is an actuating drive 31 configured to pivot the crossmember 29 about the geometric axis 29.1. The actuating drive 31 includes a swinging arm 32 connected to the crossmember 29 and a mechanism 33 that is attached on one side to the frame 30 and on the other side to the swinging arm 32, and that, in the present configuration, is configured as a screw mechanism.

Figure 4:
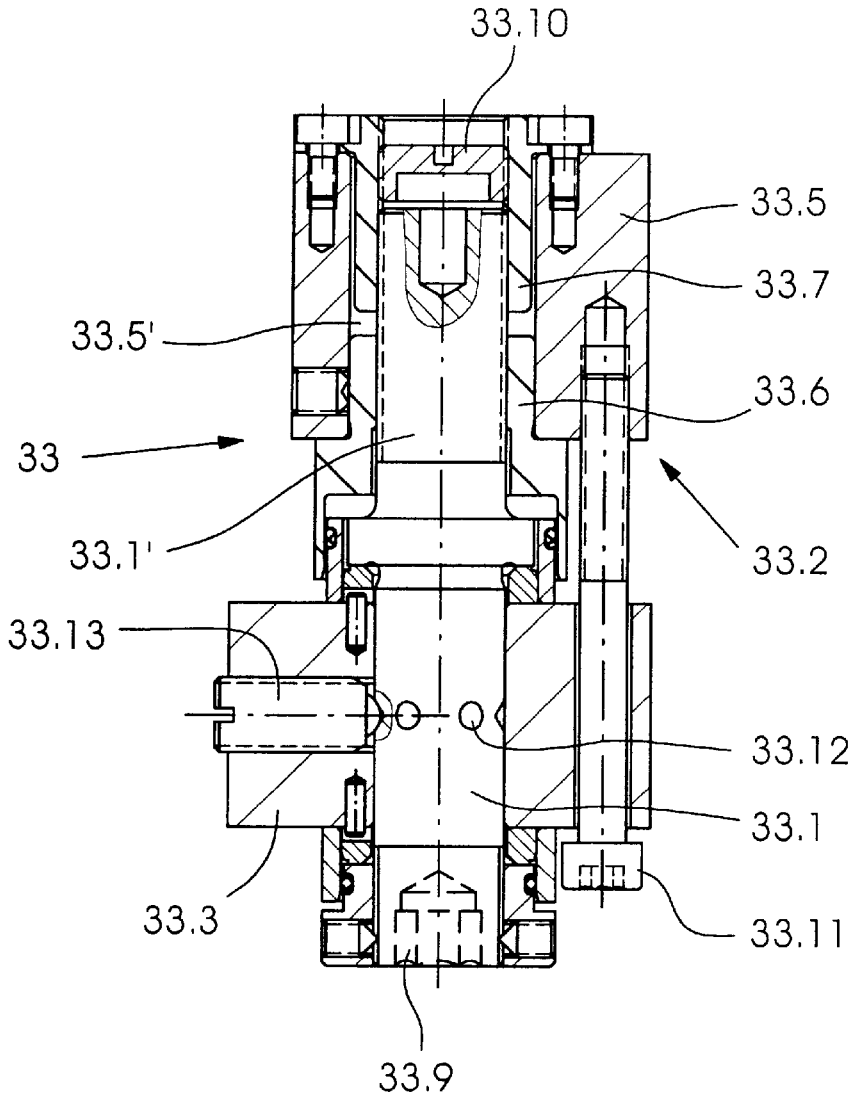
FIG. 4 is an enlarged, cross-sectional view along line IV—IV in FIG. 3 of a mechanism for adjusting the support surface of the delivery of FIG. 3 configured as a manually actuated screw mechanism.

The screw mechanism is shown in section in FIG. 4 and includes a threaded spindle 33.1 and a spindle nut configuration 33.2 cooperating with the latter without play. The threaded spindle 33.1 can be rotated and is accommodated in an axially fixed manner in a spindle housing 33.3 that is attached to the frame 30 through a bolt 33.4 that is provided therein and can be seen in particular, in FIG. 3. In the present exemplary embodiment, the spindle nut configuration 33.2 is formed by a nut housing 33.5 having a through hole 33.5', which surrounds a threaded section 33.1' of the threaded spindle 33.1, leaving an annular gap. At a respective end of the through hole 33.5', a sleeve 33.6, 33.7 is fitted into the through hole 33.5'. The sleeves 33.6 and 33.7 each have an internal thread that cooperates with the threaded spindle 33.1. The sleeves 33.6 and 33.7 are screwed onto the threaded spindle 33.1 while eliminating play between the respective internal thread of the sleeves 33.6 and 33.7, on one hand, and the thread of the threaded spindle 33.1, on the other hand, and in the process are supported on a respective end of the nut housing 33.5 penetrated by the through hole 33.5' and are ultimately connected firmly to the nut housing 33.5 so as to rotate with it. The nut housing 33.5 is connected in an articulated manner to the swinging arm 32 through a bolt 33.8 that can be seen in FIG. 3.

The actuating drive 31, configured as described to this extent as a screw mechanism, can be adjusted manually in the simplest case. For such a purpose, an internal hexagon 33.9 is machined into a freely accessible end of the threaded spindle 33.1 so that the threaded spindle 33.1 can be rotated by an appropriate plug-in key and, therefore, the spindle nut configuration 33.2 can be adjusted axially. The axial adjustment travel is limited by the stops 33.10 and 33.11 that can be seen in FIG. 4.

The adjustment of the spindle nut configuration 33.2 and, therefore, a change in the position of the support surface 27.4 with respect to the transport path 28 (see FIG. 2) is preferably possible as a result of rotation of the threaded spindle 33.1 through a predefined angle of rotation, the threaded spindle 33.1 in each case assuming a latching position after passing through the angle of rotation. For such a purpose, the shank of the threaded spindle 33.1 that is accommodated in the spindle housing 33.3 is provided with latching depressions 33.12 that are preferably spaced apart equally in the circumferential direction of the shank and disposed on a circumferential line and in which a pressure pin 33.13 inserted into the spindle housing 33.3 engages. Such a configuration provides a plurality of latching positions, between which the screw mechanism can be adjusted, so that a change in the position of the support surface 27.4 with respect to the transport path 28 by defined amounts is possible. As a result of the formation of a fine thread on the threaded spindle 33.1 and a configuration of a large number of latching depressions 33.12 on the shank of the threaded spindle 33.1, precise adjustment of the support surface 27.4 to specific working positions may be achieved.

In an expedient working position, the support surface 27.4 is moved up to the transport path 28 at least as far as the thickness of the printing material. In the event of a possible fault, in which a sheet 3 released at the aforementioned second location by one of the gripper systems 9 is not picked up properly by the conveying runs 27.1 and transported onward in the direction of the collecting device 25, the sheet 3 bridges over the leading-edge stops 12, so that following sheets 3, regardless of the location on which they are released by the gripper systems 9, can be pushed onto the sheets 3 not transported onward properly and can cause a jam, which can lead to damage.

In an advantageous refinement, the problem is, in turn, countered by variability of the physical position of the support surface 27.4 while maintaining the orientation of its generatrices. For such a purpose, as already indicated and now explained in more detail, a respective suction belt module 27 is disposed such that it can be pivoted and locked in a working position and, in the present exemplary configuration for such a purpose, is accommodated such that it can be pivoted and locked with respect to the bearing block 26.2 already mentioned and carried by the crossmember 29.

As can be seen in FIG. 3, the bearing block 26.2 firstly accommodates a drive shaft 27.8 that can rotate and is firmly connected to the second roller 27.3 of the suction belt module 27 so as to rotate with it and, secondly, accommodates the carrying frame 27.7 by a mounting that is concentric with the drive shaft 27.8. The carrying frame 27.7, as already explained, carries the suction box 27.5 over which the suction belt 27.1' sweeps and, in addition, accommodates the first roller 27.2 around which the suction belt 27.1' wraps such that it can rotate.

Figure 5:
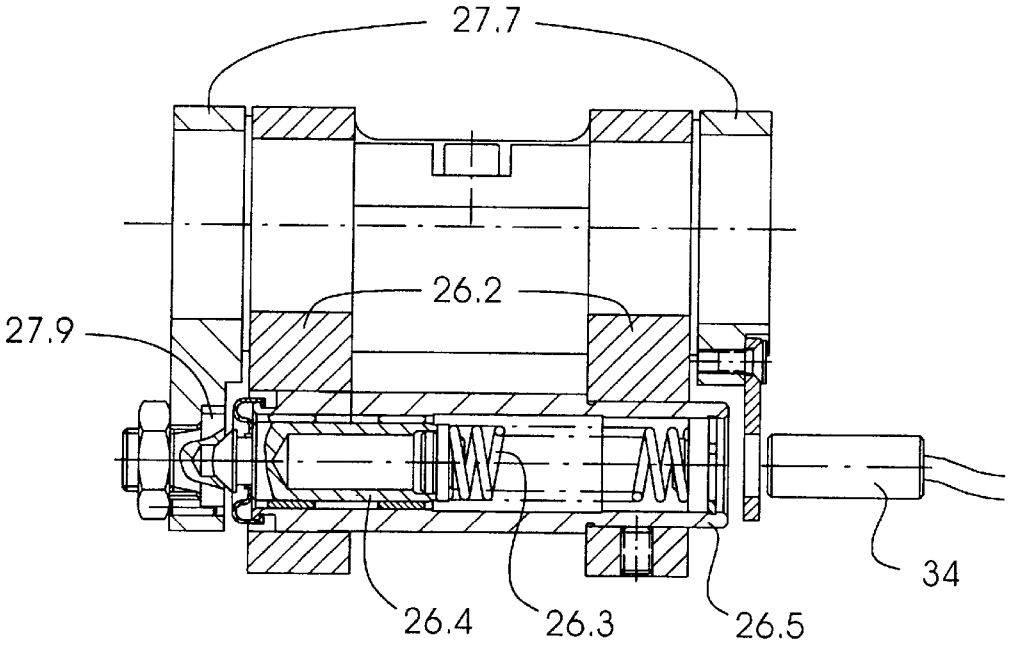
FIG. 5 is a fragmentary, enlarged, cross-sectional view along line V—V in FIG. 2 of a locking device according to the invention.

With the connection so produced between the carrying frame 27.7 and the bearing block 26.2, the carrying frame 27.7 can, in principle, be pivoted with respect to the bearing block 26.2. However, in undisrupted operation of the suction belt conveyor 26, pivoting is prevented by a locking device. The device provided for such a purpose can be seen in FIG. 5, which represents a section along the line V in FIG. 2 but in which complete reproduction of all the details has been omitted.

The locking device provided includes a latching pin 26.4 that is pre-stressed by a spring 26.3, that is accommodated in a manner parallel to the axis of the drive shaft 27.8 (see FIG. 3) in a sleeve 26.5 that is closed on one side and inserted into the bearing block 26.2, and that has a latching head that projects out of the open end of the sleeve 26.5 and, in a working position of the suction belt conveyor 26 or of the suction belt module 27, is latched in a latching recess 27.9 inserted into the carrying frame 27.7.

The engagement of the latching pin 26.4 into the latching recess 27.9, maintained by the spring 26.3, holds the suction belt module 27 in a working position in the undisrupted operation of the suction belt conveyor. In the event of the aforementioned jam, a plurality of sheets 3 released at the second location collect between the support surface 27.4 and a respective gripper system 9 passing the support surface 27.4, so that, ultimately, one of the gripper systems 9 exerts a transverse force on the conveying run 27.1 through the accumulated sheets 3; the transverse force is sufficient to cancel the latching action achieved by the spring 26.3. Given the mutual association that can be seen from FIG. 2 between the support surface 27.4 and the transport path 28 and the ability of the suction belt module 27 to pivot about the axis of rotation of the second roller 27.3 placed downstream of the first roller 27.2 with respect to the transport direction 5', the aforementioned transverse force ultimately acting on the suction box 27.5 and, therefore on the carrying frame 27.7 has the effect of pivoting the suction belt module 27 downward about the axis of rotation of the second roller 27.3 into a position moved away from the working position. As a result, with a view of the path through which the gripper systems pass in the region of the suction belt module 27—the path moving away from the support surface 27.4 along the latter—there is a clearance for the backed-up sheets. As a result of the clearance damage to the components involved in the process of removing the sheets 3 released at the second location can be prevented, in particular, by a signal that can be generated by the pivoting of the suction belt module 27 and can be used to prevent processing of further sheets 3.

To generate an appropriate signal, for example, there is provided a sensor 34 (see FIG. 5), and an configuration is made such that the sensor 34 outputs the aforementioned signal in a position of the suction belt module 27 moved out of the working position of the suction belt module 27- here, pivoted downward.

In the downwardly pivoted position of the suction belt module 27, in the present example, an extension of the carrying frame 27.7 that accommodates the latching recess 27.9 is supported on a stop 26.6 provided on the bearing block 26.2.

The circulation of the suction belt 27.1' implemented in the term suction belt conveyor and simply assumed in the above explanations, such that its conveying run 27.1 transports a sheet 3 arriving in the processing direction in accordance with arrow 5' in FIG. 1 and picked up by the suction belt conveyor 26 onward, even if with ultimately a lower speed than that of the gripper systems 9. The belt 27.1' is implemented in the present exemplary embodiment by a belt drive 35 that is accommodated in the bearing block 26.2 that, although it is indicated in FIG. 2 in the tensioned state of its belt 35.1, is illustrated without a belt tensioner. A driven wheel 35.2 of such a belt drive 35 is firmly connected to the drive shaft 27.8 of the suction belt module 27 so as to rotate with it (see FIG. 3), while a drive wheel 35.3 is firmly connected so as to rotate with a shaft 35.4 that is merely indicated in FIG. 2 and in cross-section there and is mounted and driven in a manner not specifically illustrated. Such a configuration is provided for each conveying module 26.1, the shaft 35.4 being common to these. In the simplest case, the shaft 35.4 rotates uniformly and imparts to the respective conveying run 27.1 a circulating speed that is lower than the speed of the gripper systems 9 and based upon the basis of which the sheets 3 attracted against the support surface 27.4 under the action of the aforementioned vacuum generator are finally braked to a removal speed. At the removal speed, the sheets 3 ultimately strike stops 25.1 that, with respect to the processing direction, are provided at a downstream end of the collecting device 25.

In the configurations discussed herein, although the change in the physical position of the respective support surface 27.4 is respectively carried out by using a pivoting movement of the respective suction belt module 27, there is no restriction to such an effect, so that a translational adjustment of the suction belt modules 27 also lies within the scope of the invention.

I claim:

1. A delivery for a machine having a frame and processing flat printing materials in a transport direction along a transport path, the transport path defining a transport generatrix, the delivery comprising:

circulating gripper systems each dragging a printing material in the transport direction along the transport path during operation of the machine and selectively releasing the printing material at one of:

a first location on the transport path to form a material stack; and a second location on the transport path downstream of the first location with respect to the transport direction;

a suction belt conveyer having a geometric axis parallel to the transport generatrix of the transport path, said suction belt conveyer including suction belt modules each having:

a first roller;

a second roller disposed downstream of said first roller with respect to the transport direction; and a conveying run connected to said first roller and to said second rollers and running from said first roller to said second roller during operation of the machine;

a crossmember:

defining said geometric axis, pivotably mounted in the frame about said geometric axis, selectively adjustable to different pivoting positions, and carrying and adjusting said suction belt conveyor to different working positions by pivoting about said geometric axis;

said conveying run of each of said suction belt modules forming a variable support surface for a printing material released at the second location, said variable support surface defining a support generatrix oriented parallel to the transport generatrix of the transport path; and a physical position of said support surface being variable while maintaining an orientation of said support generatrix.

2. The delivery according to claim 1, including an actuating drive connected to said crossmember and pivoting said crossmember about said geometric axis.

3. The delivery according to claim 1, including:

a swinging arm connected to said crossmember; and a mechanism having two sides, a first of said sides connected to the frame and a second of said sides connected to said swinging arm, said connection of said swinging arm to said second side forming a pivot mechanism for said crossmember about said geometric axis.

4. The delivery according to claim 1, including:

a swinging arm connected to said crossmember; and a pivot mechanism having two sides, a first of said sides connected to the frame and a second of said sides connected to said swinging arm for pivoting said crossmember about said geometric axis.

5. The delivery according to claim 1, wherein:

said suction belt modules are adjustable between a working position and a position located away from said working position;

a locking device releasably fixes each of said suction belt modules in said working position; and said locking device releases a respective one of said suction belt modules from said working position through a transverse force loading said conveying run of said one suction belt module.

6. The delivery according to claim 3, wherein said mechanism is a screw device and includes:

a threaded spindle; and a spindle nut configuration moveably connected to said threaded spindle.

7. The delivery according to claim 6, wherein said spindle nut configuration is rotatably connected to said threaded spindle.

8. The delivery according to claim 6, wherein said spindle nut configuration is moveably connected to said threaded spindle without play.

9. The delivery according to claim 6, wherein said mechanism has:

a spindle housing connected to the frame;

said spindle housing accommodates said threaded spindle to axially fix said threaded spindle and permit rotation of said threaded spindle; and said spindle nut configuration is connected articulatedly to said swinging arm.

10. The delivery according to claim 4, wherein said mechanism is adjustable between a plurality of latching positions.

11. The delivery according to claim 5, wherein:

each of said suction belt modules has:

a carrying frame; and a bearing block connected to said carrying frame to permit pivoting of said carrying frame with respect to an axis of rotation of said second roller; and said locking device has a pre-stressed latching pin connected between said carrying frame and said bearing block.

12. A delivery for a sheet-processing rotary printing machine having a frame and processing flat sheets in a transport direction along a transport path, the transport path defining a transport generatrix, the delivery comprising:

circulating gripper systems each dragging a sheet in the transport direction along the transport path during operation of the printing machine and selectively releasing the sheet at one of:

a first location on the transport path to form a sheet stack; and a second location on the transport path downstream of the first location with respect to the transport direction;

a suction belt conveyer having a geometric axis parallel to the transport generatrix of the transport path, said suction belt conveyer including suction belt modules each having:

a first roller;

a second roller disposed downstream of said first roller with respect to the transport direction; and a conveying run connected to said first roller and to said second rollers and running from said first roller to said second roller during operation of the printing machine;

a crossmember:

defining said geometric axis, pivotably mounted in the frame about said geometric axis, selectively adjustable to different pivoting positions, and carrying and adjusting said suction belt conveyor to different working positions by pivoting about said geometric axis;

said conveying run of each of said suction belt modules forming a variable support surface for a sheet released at the second location, said variable support surface defining a support generatrix oriented parallel to the transport generatrix of the transport path; and a physical position of said support surface being variable while maintaining an orientation of said support generatrix.

13. In a sheet-processing rotary printing machine processing flat sheets in a transport direction along a transport path, the transport path defining a transport generatrix, a sheet delivery comprising:

circulating gripper systems each dragging the sheet in the transport direction along the transport path during operation of the printing machine and selectively releasing the sheet at one of:

a first location on the transport path La form a sheet stack; and a second location on the transport path downstream of the first location with respect to the transport direction;

a suction belt conveyer with suction belt modules each having:

a first roller;

a second roller disposed downstream of said first roller with respect to the transport direction; and a conveying run connected to said first roller and to said second rollers and running from said first roller to said second roller during operation of the printing machine;

said suction belt modules being adjustable between a working position and a position located away from said working position;

a locking device releasably fixing each of said suction belt modules in said working position; and said locking device releasing a respective one of said suction belt modules from said working position through a transverse force loading said conveying run of said one suction belt module;

said conveying run of each of said auction belt modules forming a variable support surface for a sheet released at the second location, said variable support surface defining a support generatrix oriented parallel to the transport generatrix of the transport path; and a physical position of said support surface being variable while maintaining an orientation of said support generatrix.

14. A delivery for a machine processing flat printing materials in a transport direction along a transport (path, the transport path defining a transport generatrix, the delivery comprising:

circulating gripper systems each dragging a printing material in the transport direction along the transport path during operation of the machine and selectively releasing the printing material at one of:

a first location on the transport path to form a material stack, and a second location on the transport path downstream of the first location with respect to the transport direction;

a suction belt conveyer with suction belt modules each having:

a first roller, a second roller disposed downstream of said first roller with respect to the transport direction, and a conveying run connected to said first roller and to said second rollers and running from said first roller to said second roller during operation of the machine;

said suction belt modules being adjustable between a working position and a position located away from said working position;

a locking device releasably fixing each of said suction belt modules in said working position; and said locking device releasing a respective one of said suction belt modules from said working position through a transverse force loading said conveying run of said one suction belt module;

said conveying run of each of said suction belt modules forming a variable support surface for a printing material released at the second location, said variable support surface defining a support generatrix oriented parallel to the transport generatrix of the transport path; and a physical position of said support surface being variable while maintaining an orientation of said support generatrix.

* * * * *